United States Patent [19]

Sperling

[11] 4,024,831

[45] May 24, 1977

[54] TRANSPARENT RULER HAVING LONGITUDINALLY POSITIONED COLORED AREA FOR ISOLATING ROWS OF SYMBOLS FOR RAPID SCANNING

[76] Inventor: Benjamin Sperling, 49 McKay Drive, Tenafly, N.J. 07670

[22] Filed: Oct. 10, 1975

[21] Appl. No.: 621,472

[52] U.S. Cl. ..... 116/119; 33/107 R; 116/114 AJ

[51] Int. Cl.[2] ..... B42D 19/00

[58] Field of Search ..... 116/119, 130, 135, 114 R, 116/114 AJ; 281/45, 42; 40/352; 35/2; 33/107 R, 111

[56] References Cited

UNITED STATES PATENTS

| | | | |
|---|---|---|---|
| 1,353,279 | 9/1920 | Schulthess | 40/352 |
| 2,585,421 | 2/1952 | Dumais | 116/119 |
| 2,841,109 | 7/1958 | Marty | 116/119 |
| 3,352,487 | 11/1967 | Olson | 116/119 |
| 3,408,977 | 11/1968 | Colman | 116/119 |
| 3,719,161 | 3/1973 | Wegner | 281/42 |
| 3,739,739 | 6/1973 | Brase | 116/119 |

*Primary Examiner*—S. Clement Swisher
*Assistant Examiner*—Denis E. Corr
*Attorney, Agent, or Firm*—Charles E. Temko

[57] ABSTRACT

A transparent ruler formed of synthetic resinous materials having a longitudinal strip of contrasting light transmitting properties which may overlie a line of characters in a group of such lines to facilitate the rapid scanning thereof.

2 Claims, 6 Drawing Figures

FIG. 1
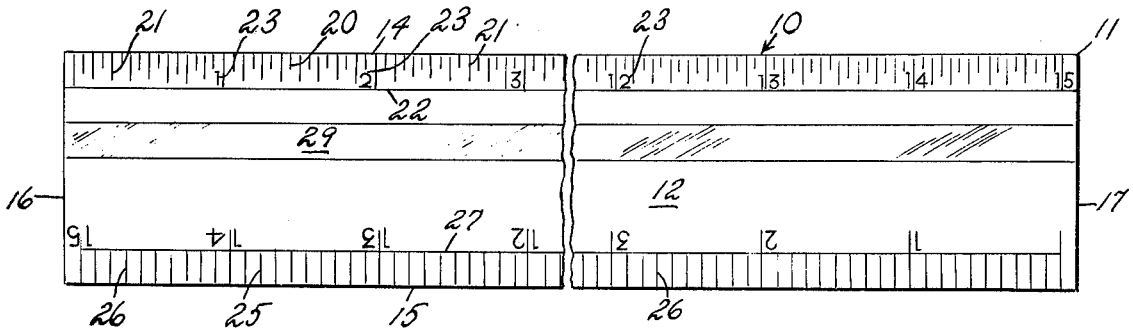
FIG. 2
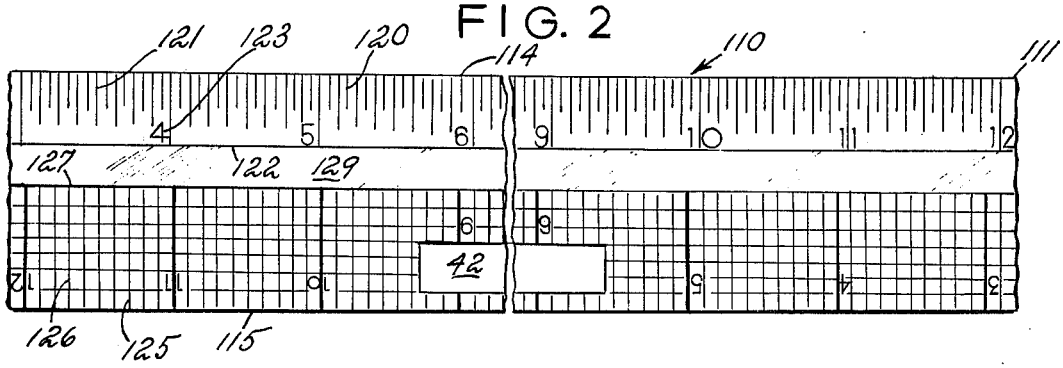
FIG. 3
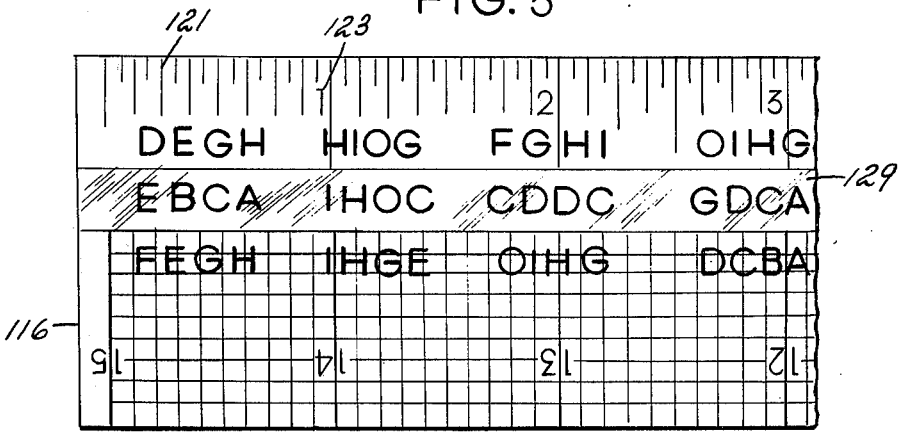
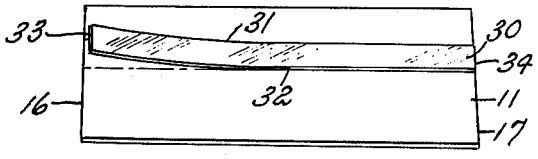
FIG. 4
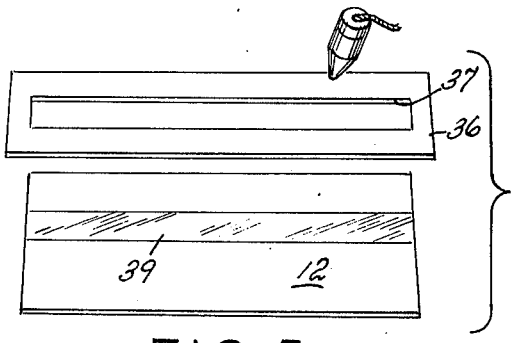
FIG. 5

TRANSPARENT RULER HAVING LONGITUDINALLY POSITIONED COLORED AREA FOR ISOLATING ROWS OF SYMBOLS FOR RAPID SCANNING

BACKGROUND OF THE INVENTION

The problem of reading separate lines of information of a type appearing in computer printouts, telephone directories, stock exchange quotations and the like is known. U.S. Pat. No. 3,739,739, granted June 19, 1973 to Roy J. Brase, for example, discloses an instrument for facilitating such reading in the form of a pair of laminated strips of synthetic resinous material in which areas of tinted and non-tinted material are juxtaposed to define guides which may be alined with a desired row of characters for isolating individual lines of data.

While such devices are of acknowledged utility where a large amount of such scanning is performed, many persons require an instrument of this general type for use at relatively infrequent intervals, and in which the cost of manufacture is considerably lower owing to economies in design and manufacture.

SUMMARY OF THE INVENTION

Briefly stated, the invention contemplates the provision of a generally conventional ruler of synthetic resinous transparent material in which the areas employed for scanning a desired line of data are formed by printing or etching on the surface of the ruler to significantly alter the light transmissive qualities thereof, such printing and etching forming the measuring graduations of the ruler. In one embodiment, a contrasting tint is applied by means of a separately attached strip of colored transparent material. In another, the same result is obtained by means of a stencil spray of lacquer or acrylic material.

BRIEF DESCRIPTION OF THE DRAWING

In the drawing, to which reference will be made in the specification, similar reference characters have been employed to designate corresponding parts throughout the several views.

FIG. 1 is a fragmentary top plan view of a first embodiment of the invention.

FIG. 2 is a fragmentary top plan view of a second embodiment thereof.

FIG. 3 is an enlarged fragmentary plan view corresponding to a part of the structure shown in FIG. 2, and showing the device in use for line scanning purposes.

FIG. 4 is a reduced view in perspective showing a step in the formation of the first embodiment.

FIG. 5 is an exploded view in perspective showing a step in the manufacture of either the first or second embodiment.

DETAILED DESCRIPTION OF THE DISCLOSED EMBODIMENTS

Figure 6:
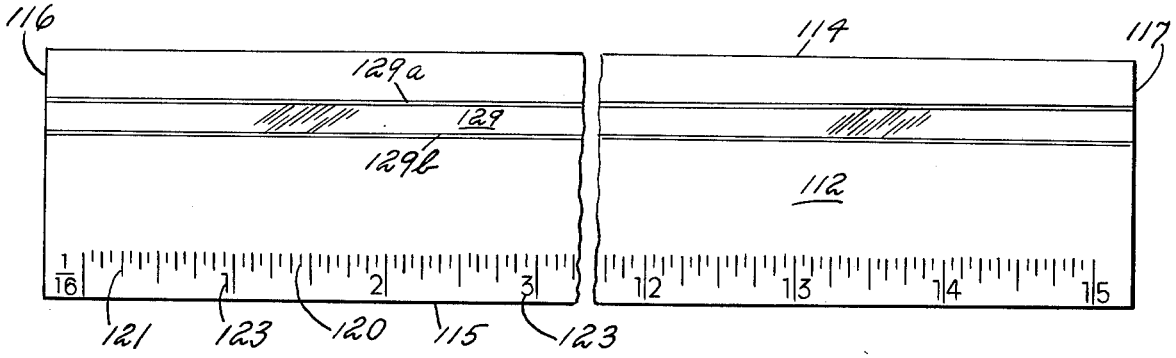
FIG. 6 is a fragmentary top plan view of a third embodiment of the invention.

In accordance with the first embodiment of the invention, the device, generally indicated by reference character 10 includes a molded or extruded strip of synthetic resinous material in the form of a rectangular blank 11. The strip is bounded by an upper surface 12, a lower surface (not shown), longitudinal edges 14 and 15, and end edges 16 and 17.

Extending along and adjacent to the longitudinal edge 14 is a first scale 20 formed by transversely extending graduations 21 terminating in a marginal line 22. Numeral designations 23 are positioned at conventionally spaced increments as is well known in the art.

A second edge scale 25 is similarly positioned along the edge 15. Transversely extending graduations 26 terminate in a similar marginal line 27, whereby a relatively clear area 29 is disposed between the first and second scales.

Referring to FIG. 4, a strip of thin tinted material 30 is secured to the strip 11, either by the use of cementitious materials (not shown), or by a simple heat-sealing step. The strip 30 is of rectangular configuration, and is bounded by longitudinal edges 31 and 32, as well as end edges 33 and 34. The edges 31 and 32 are parallel to the edges 14 and 15, while the edges 33 and 34 are preferably in congruent relation with respect to the edges 16 and 17.

Referring to FIG. 5 in the drawing, the equivalent of the tinted strip 30 may be formed by providing a stencil 36 having an opening 37 therein which is positioned upon the upper surface 12 prior to spraying or painting a tinting material (not shown). Upon completion of this operation, a tinted rectangular area 39 is formed on the upper surface 12, the shape of which corresponds to the strip 30.

Turning now to the second embodiment of the invention, parts corresponding to those of the principal embodiment have been designated by similar reference characters with the additional prefix "1", thereby avoiding needless repetition.

The second embodiment differs from the first embodiment in the formation of the scales 120 and 125 such that they cover a much greater portion of the total upper surface of the strip 111, making the addition of the tinted material 30 or the FIG. 5 equivalent unnecessary. The marginal lines 22 and 27 are spaced sufficiently close that they define a clear area 41 which is of the same width as the strip 30 in the first embodiment. In addition, a separate clear area 42 of somewhat greater width is also provided (FIG. 2) which may be used either for scanning lines of somewhat greater width, or may be subsequently imprinted with advertising material, where the device is distributed as an advertising specialty.

Turning now to the third embodiment of the invention, parts corresponding to those of the first embodiment have been designated by similar reference characters with an additional prefix "1".

The third embodiment of the invention differs from the first embodiment principally in the elimination of the first scale 20 and its corresponding loss of function. The elongated area 29 of the first embodiment is replaced by a tinted strip 129, optionally bordered by ruled lines of a contrasting color **129*a* and 129*b***. This construction is desirable where very low production costs are desired, and particularly useful where it is desirable to be able to simultaneously view lines of data other than those being read.

I wish it to be understood that I do not consider the invention limited to the precise details of structure shown and described in this specification, for obvious modifications will occur to those skilled in the art to which the invention pertains.

I claim:

1. As a new article of manufacture, an improved ruler of generally rectangular configuration and as transparent synthetic resinous material; said ruler having first and second edges bordering a planar surface thereof, at least one scale imprinted on said surface adjacent one of said first and second edges, said scale being bordered by a longitudinally extending line spaced inwardly from said first and second edges and parallel thereto, whereby an elongated area of relatively greater light transmissive ability is formed, a portion of said area, medially positioned relative to said first and second edges being tinted along a longitudinally extending axis, said area serving as a means for isolating rows of printed symbols for the rapid scanning thereof; said tinted portion being formed by lamination of a separate strip of tinted material.

2. Structure in accordance with claim 1, in which said tinted material is formed as result of the application of a flowable tinted material.

* * * * *